United States Patent [19]

Sauer

[11] Patent Number: 4,979,848

[45] Date of Patent: Dec. 25, 1990

[54] DRILLING DEVICE

[76] Inventor: Gerhard Sauer, St. Jakob, Thurn 125, A-5412 Puch, Salzburg, Austria

[21] Appl. No.: 430,569

[22] Filed: Nov. 2, 1989

[30] Foreign Application Priority Data

Nov. 3, 1988 [AT] Austria ..... 2704/88

[51] Int. Cl.[5] ..... E21B 3/00; E21D 20/00

[52] U.S. Cl. ..... 405/259; 405/260; 175/386; 175/402

[58] Field of Search ..... 405/258, 259, 260; 175/386, 402

[56] References Cited

U.S. PATENT DOCUMENTS

| | | | |
|---|---|---|---|
| Re. 32,076 | 2/1988 | Dziedzic | 405/258 X |
| 2,667,037 | 1/1954 | Thomas et al. | 405/260 |
| 3,306,051 | 2/1967 | Howlett | 405/260 |
| 3,682,260 | 8/1972 | Klemm | 175/386 X |
| 3,973,409 | 8/1976 | Asayama | 405/260 |
| 4,253,781 | 3/1981 | Fischer et al. | 405/260 |
| 4,718,791 | 1/1988 | Weatherby | 405/258 X |

*Primary Examiner*—Dennis L. Taylor
*Assistant Examiner*—John Ricci
*Attorney, Agent, or Firm*—Collard, Roe & Galgano

[57] ABSTRACT

A process for protecting nonstable or moderately stable, cohesionless to slightly cohesive geologic formations, in particular, in tunnel construction, in which drill holes are first made by boring into the formation and, following completion of the boring, the drilling rod is removed. During this removal a hardenable injection material is forced into the drill hole, whereby, using a drilling rod, a pointed rod or anchoring element is placed in position in the boring. This element remains in the boring during removal of the drilling rod, and is solidly connected to the formation by the injection material.

7 Claims, 2 Drawing Sheets

DRILLING DEVICE

BACKGROUND OF THE INVENTION

1. Field of the Invention

The present invention relates to a process for protecting nonstable or moderately stable, cohesions to slightly cohesive geologic formations, in particular, in tunnel construction, in which drill holes are first made in the formation and, following completion of the borings, the drilling rods are removed, and a hardenable injection material is forced into the drill hole, during the removal.

2. The Prior Art

In cavity construction, extended drilling in soft or unconsolidated rock is either avoided or executed by means of costly machinery such as shields, hydroreinforced breasts or the like or by means of extensive injection procedures or freezing methods.

An additional complex and expensive process comprises the combination of compressed air and the new Austrian method of tunnel construction. These processes have the drawback that expensive mechanical means are required for their implementation. Especially with shorter tunnels or in the eventuality that only smaller sections of a longer tunnel require more labor- and cost-intensive reinforcement measures owing to the presence of unconsolidated rock, utilization of such processes is not justified by the attendant expense.

Injection boring anchors and preliminary breast boards with preliminary breast sheets, preliminary breast pointed bars and the like constitute another variation of advance protection known in the art. These safety provisions can be set up on site with relatively low equipment costs. A drawback of the injection boring anchor is the fact that the drill bit remains together with the anchoring element inside the borehole and is consequently lost. This results in relatively high consumption of expensive materials.

In addition, injection bar methods (alluvial pointed bars) are known in the art according to which, following construction of the borehole, the drilling rod is removed from the drill hole and an anchoring element or pointed bar inserted which is cast into the borehole by means of a hardenable injection material. This process exhibits the disadvantage that several operation cycles are required for its implementation, with the result that work progress is necessarily slow. Additionally, the drill hole can collapse between the removal of the drilling rod and introduction of the alluvial pointed bar, necessitating additional time consuming operations.

SUMMARY OF THE INVENTION

It is an object of the present invention to eliminate the aforesaid drawbacks and to provide a process for the protection of cavities or slopes which can be effected with minimal equipment requirements and, essentially, in one operation.

The above object is accomplished in accordance with the present invention by providing a method for the introduction of a pointed bar or anchoring element into the borehole together with said drilling rod, which pointed bar or anchoring element remains inside the borehole during extraction of the drilling rod, said pointed bar is solidly joined to the formation by virtue of the injection material. This method results in the fact that, except for the drilling and removal of the drill, no additional operation cycles are required. The costly drill bit can thus be recovered and reused until it is no longer usable due to wear and tear. The injection material which is injected through the drilling rod while the latter is being extracted, maintains the anchoring element fixed in position and, following hardening of the material, joins it solidly to the surrounding rock. Furthermore, this method also provides reliable protection against corrosion. The drilling rod essentially corresponds to drilling rods known in the art, with the exception that the borehole is enlarged in an axial direction toward the anchoring element mounting.

The hardenable injection material is preferably injected via the scavenging channel. This enables the design of the drilling rod to be particularly simple because no additional channel to inject the injection material is required.

The invention contemplates providing a drill injection shield by means of anchoring elements or pointed bars which slant outwardly in the drilling direction, whereupon excavation is performed under the drill injection shield and, following excavation, the surrounding rock is protected by injection anchoring elements. In this way, an advance protection as well as an additional protection of the surrounding rock can be optimally achieved by virtue of the injection anchoring elements, also resulting in a substantial increase in the bearing strength of the rock.

The invention also relates to a device to implement the process with a drilling rod which has a channel in an axial direction and which has a drill head at its front end. This device has an anchoring element or pointed bar, capable of being ejected in a forward direction, and mounted in the channel. This configuration makes it possible for the pointed bar to remain behind in the drill head together with the drill during extraction of the drilling rod. It is additionally advantageous if the inserted anchoring element or pointed bar occupies only a part of the cross-sectional surface of the channel. In this way a scavenging liquid or an injection material can be forced in the remaining cross-section of the channel toward the drill head.

The anchoring element or pointed rod expediently displays at least in one section a cross-section which deviates from circularity, which cross-section is advantageously arranged in the area of the drill head and which can be mounted fixedly on a corresponding section of the channel. In particular, the front end of the anchoring element or pointed bar can be outfitted with a drilling device. By virtue of a torsion-proof connection of the anchoring element or pointed bar to the drill head or the drilling rod and the existence of a tooth at the tip of the anchoring element, the anchoring element participates in the drilling. In this way the pressure applied to this anchoring element during drilling can be substantially reduced.

The process according to the invention has the advantages that it is possible to protect unconsolidated rock materials not only in tunnel construction but also in other related fields of engineering. In addition to speeding up working operations, qualitative improvements can also be realized in tunnel construction.

BRIEF DESCRIPTION OF THE DRAWINGS

Other objects and features of the present invention will become apparent from the following detailed description considered in connection with the accompanying drawing which discloses one embodiment of the present invention. It should be understood,, however, that the drawing is designed for the purpose of illustration only and not as a definition of the limits of the invention.

In the drawing wherein similar reference characters denote similar elements throughout the several views.

DETAILED DESCRIPTION OF PREFERRED EMBODIMENT

Figure 1:
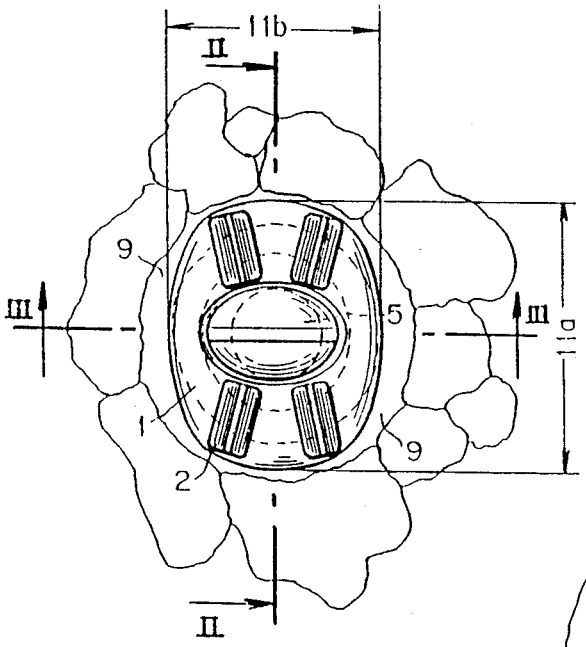
FIG. 1 shows an axial view of a device according to the invention.
Figure 2:
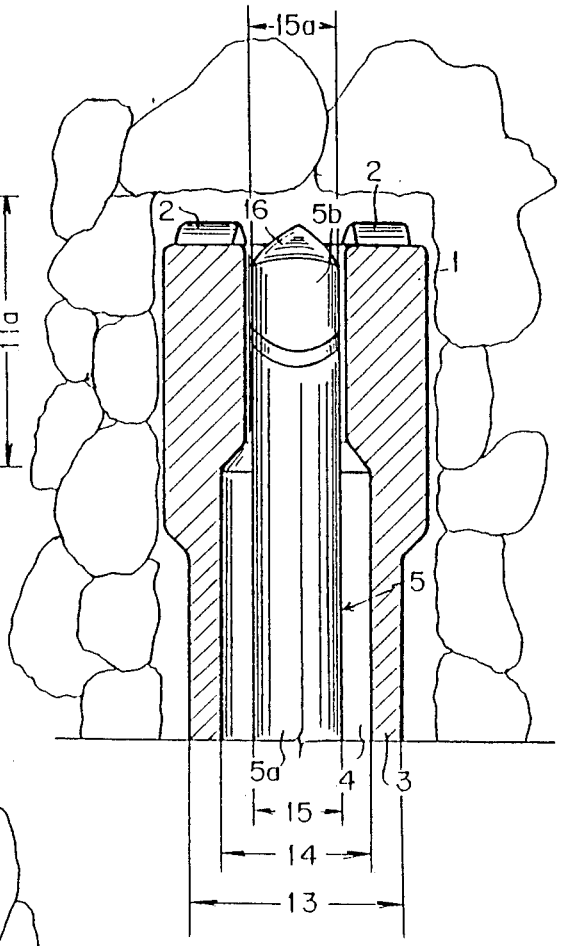
FIG. 2 shows a sectional view along the line II—II of FIG. 1.
Figure 3:
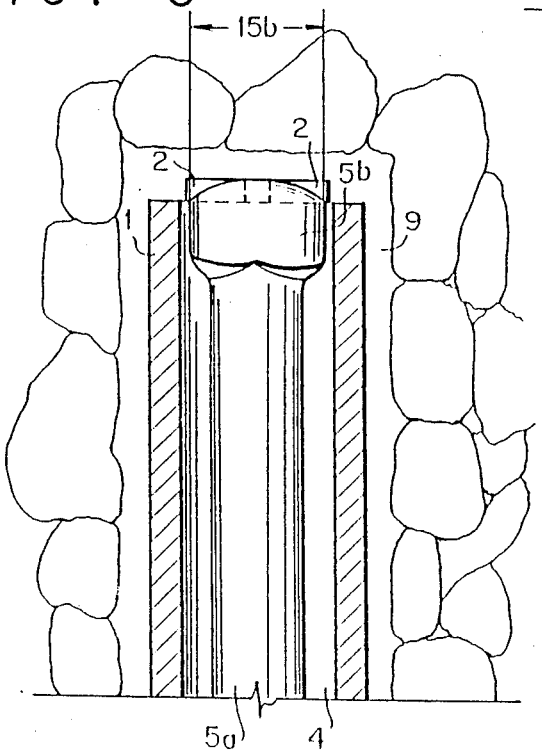
FIG. 3 shows a sectional view along the line III—III of FIG. 1.

The device according to the invention consists of a drill head 1 solidly connected to a drilling rod 3. the drilling rod 3 has a circular cross-section. carbide-tipped teeth 2 are provided on the front side of the drill head 1 for drilling. The drill head 1 exhibits an essentially oval cross-section whose large diameter 11*a* extends beyond the outside diameter 13 of the drilling rod 3 and whose small diameter 11*b* essentially corresponds to the outside diameter 13 of the drill rod. In this fashion a bore having a circular cross-section is obtained during drilling whose diameter corresponds approximately to the large diameter 11*a* of the drill head 1. In the interior of the drilling rod 3 an anchoring element or pointed bar 5 is provided which consists of a cylindrical member 5*a* and a thickened anchoring head 5*b*. The diameter 15 of the cylindrical element 5*a* is distinctly smaller than the inside diameter 14 of the drill rod 3. In this way an annular space 4 remains unoccupied between the anchoring element 5 and the drilling rod 3 through which a scavenging fluid or similar fluid can be pumped to the drill head 1. The thickened anchoring head 5*b* exhibits an essentially oval cross-section whose larger diamter 15*b* is larger than the diameter 15 of the cylindrical element 15*a* while the small diameter 15*a* corresponds approximately to the diameter 15 of the cylindrical element 15*a*. The thickened anchoring head 5*b* of the anchoring element 5 is supported in a corresponding opening of the drill head 1 which exhibits so much free space such that the scavenging fluid is able to pass through but the anchoring element 5 is unable to execute any torsional movement with respect to the drill head 1 or the drilling rod 3. The anchoring element 5 is provided with a tooth 16 at its tip which participates in the drilling.

The following method of operation is executed in utilizing the device according to the invention. The anchoring element 5 is introduced into the drilling rod 3. This, depending on the respective requirements, can be performed from the front or from the back. The drilling rod 3 is thereupon conneted in a manner known in the art to a percussion drill assembly not shown. Drilling of the drill head 1 into the rock to be protected now takes place. During drilling, a scavenging fluid is forced by the usual method through the annular space 4 to the drill head 1 in order to flush away drill cuttings. Removal is effected via channels 9 which remain unengaged between lateral flattenings of the drill head 1 and the wall of the boring. As soon as the boring has reached maximum depth, the drilling operation is terminated and in place of the scavenging fluid, a hardenable injection material, like, for example, special-purpose cement mortar, synthetic resins, synthetic-natural compound mixtures and the like, is forced though the annular space 4. At the same time, the drilling rod 3, together with the drill head 1, is removed from the borehole. The pressure exerted by the injection material on the thickened anchoring head 5*b* ensures that the anchoring element 5 remains in position. The anchoring element is completely enveloped by the injection material with the result that, following hardening of the injected material, it is solidly cast into the borehole.

Figure 4:
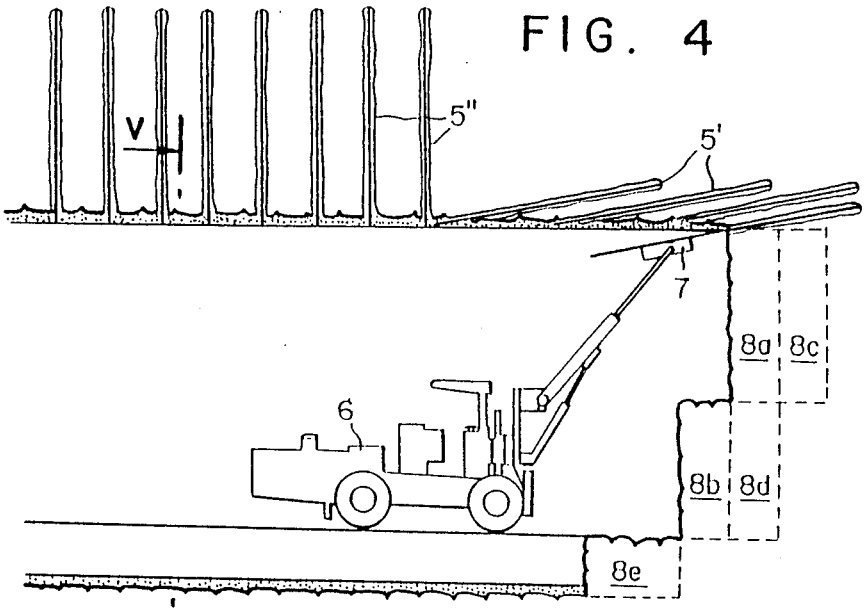
FIG. 4 shows, in a longitudinal cross-sectional view, an embodiment of the process according to the invention and of the device according to the invention during tunnel drilling operations.
Figure 5:
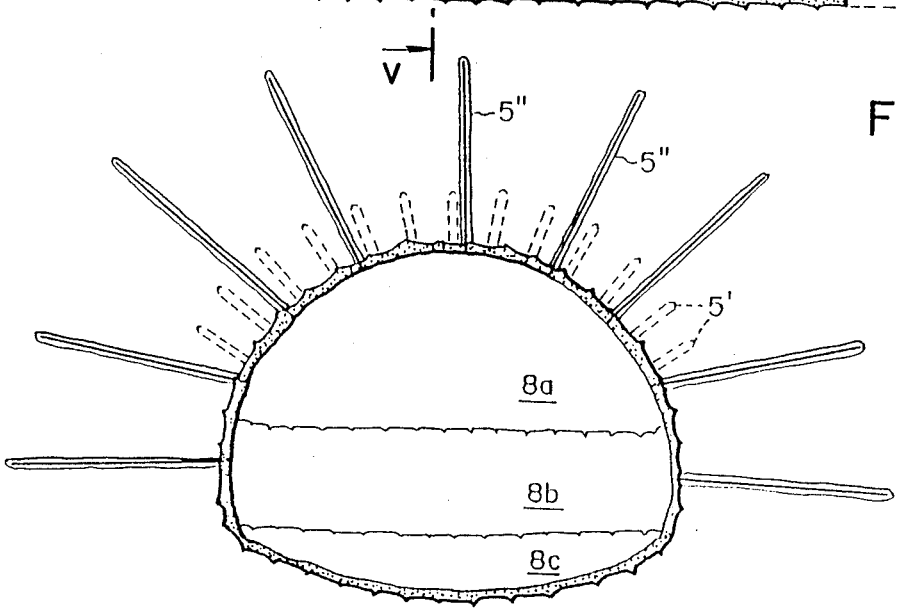
FIG. 5 shows a sectional view along the line V—V of FIG. 4.

During the tunnel drilling operations shown in FIGS. 4 and 5 a shield of anchoring elements $5^{I}$ is put in place by means of a drill cradle 6 on which a percussion drill device 7 is pivotally mounted. The anchoring elements are radially arrayed outwardly in the direction of drilling. After several of these anchoring elements $5^{I}$ have been placed in position, excavation takes place, for example, in the following sequence: 8*a*, 8*b*, 8*c*, 8*d*, 8*e*. To provide final protection to the tunnel, additional anchoring elements $5^{II}$ are placed in position in a radial direction, which elements have an arching effect on the surrounding rock to which any kind of tunnel casing can be securely affixed.

Figure 6:
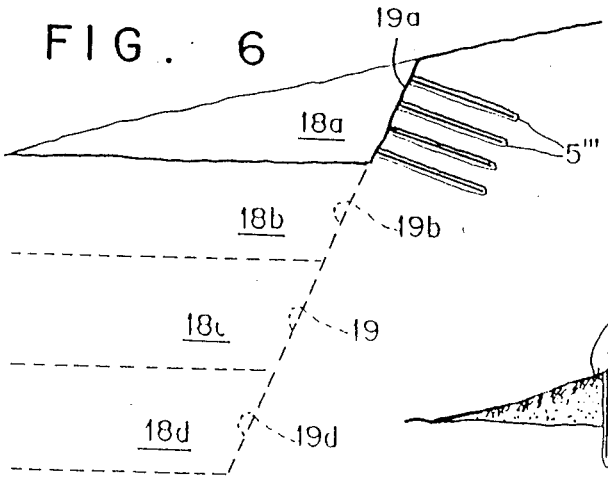
FIG. 6 shows a cross-sectional view of a protection system for a deep-level excavation.

The process according to the invention can also be used to protect deep-level slope cuts, as is shown in FIG. 6. A cut is first made into the inclined slope 18*a*. Flank 19*a* is protectively secured by means of the anchoring elements $5^{III}$. In succession, the cut is deepened step by step by the sections 18*b*, 18*c* and 18*d*. Flanks 19*b*, 19*c*, and 19*d*, respectively, are protected in analogous fashion by means of additional anchoring elements not depicted.

Figure 7:
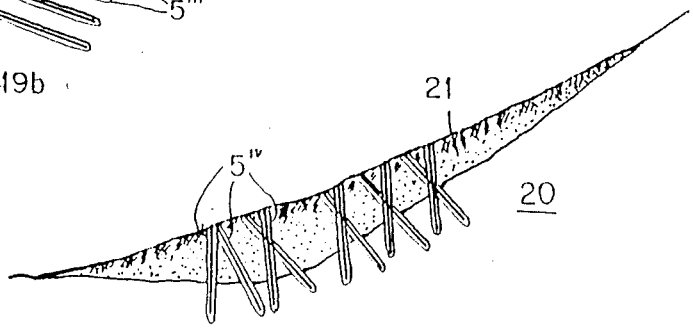
FIG. 7 shows a cross-sectional view of a protection system against deep-level slope slippage.

As shown in FIG. 7, slope slippage can also be prevented. Where it is feared that unconsolidated rock materials 21 could slide down from a slope 20, such slippage can be prevented through the crosswise configuring in position of the anchoring elements $5^{IV}$.

While only one embodiment of the present invention has been shown and described, it is to be understood that many changes and modifications may be mmade thereunto without departing from the spirit and scope of the invention as defined in the appended claims.

What is claimed is:

1. A device for protecting a non-stable or moderately stable, non-cohesive or slightly cohesive geological formation, comprising:

(a) a hollow drilling rod having an outer diameter and defining an axially extending channel leading to a front end of the drilling rod, (b) a drill head at the front end of the drilling rod, the drill head having a front end and a cross-section deviating from circularity and having a large diameter and a small diameter, the small diameter of the drill head corresponding essentially to the outer diameter of the drilling rod, and the drill head defining an axially extending channel axially aligned with the drilling rod channel, the drill head channel having a cross-section deviating from circularity and having a large diameter and a small diameter, (c) cutting teeth arranged on the front end of the drill head, (d) an anchoring element inserted in the drilling rod channel and capable of being ejected through the front end, (e) an anchoring element head on said anchoring element and extending into the drill head channel, the anchoring element head having a cross-section deviating from circularity and having a large diameter and a small diameter, the small diameter of the anchoring element head corresponding approximately to the diameter of the anchoring element, the small diameter of the drill head channel being smaller than the large diameter of the anchoring element head and the large diameter of the drill head being larger than the large diameter of the anchoring element head, and ((f) a cutting tooth on the anchoring element head.

2. The device of claim 1, wherein the cross-section of the drill head is substantially oval.

3. The device of claim 2, wherein the cross-sections of the drill head channel and of the anchoring element head are substantially oval.

4. The device of claim 1, wherein the anchoring element inserted in the drilling rod channel occupies only a portion of the cross-sectional area of said channel.

5. The device of claim 4, wherein a substantially circular wall defines the drilling rod channel, the circular channel wall defining an empty space with the anchoring element for receiving a scavenging fluid or an injection material.

6. The device of claim 1, wherein the anchoring element has a section having a cross-section deviating from circularity, said anchoring element section being non-rotatable in a corresponding section of the channel wherein it is inserted.

7. The device of claim 8, wherein said anchoring element section extends into the drill head channel.

* * * * *